US005807794A

United States Patent [19]

Knox et al.

[11] Patent Number: 5,807,794

[45] Date of Patent: Sep. 15, 1998

[54] REINFORCED KNITTED FABRIC STRUCTURE USEFUL IN SEATING APPLICATIONS

[75] Inventors: Gettys Knox, Union; Anthony R. Waldrop, Easley; Steven W. Josey, Moore; George C. McLarty, III, Greenville, all of S.C.

[73] Assignee: Milliken Research Corporation, Spartanburg, S.C.

[21] Appl. No.: 863,974

[22] Filed: May 27, 1997

Related U.S. Application Data

[63] Continuation-in-part of Ser. No. 744,176, Nov. 5, 1996, abandoned, and Ser. No. 630,381, Apr. 10, 1996, Pat. No. 5,632,526, which is a division of Ser. No. 337,260, Nov. 10, 1994, Pat. No. 5,533,789.

[51] Int. Cl.[6] ..... B32B 7/00

[52] U.S. Cl. ..... 442/306; 66/192; 66/195; 66/202; 442/311; 442/314; 442/318

[58] Field of Search ..... 442/306, 312, 442/313, 314, 318, 311; 66/192, 195, 202

[56] References Cited

U.S. PATENT DOCUMENTS

| | | | |
|---|---|---|---|
| 2,251,318 | 8/1941 | Blair et al. | 155/179 |
| 4,469,738 | 9/1984 | Himeireich, Jr. | 428/198 |
| 4,469,739 | 9/1984 | Gretzinger et al. | 428/198 |
| 4,545,614 | 10/1985 | Abu-Isa et al. | 297/284 |
| 4,869,554 | 9/1989 | Abu-Isa et al. | 297/452 |
| 5,013,098 | 5/1991 | Abu-Isa et al. | 297/452 |

*Primary Examiner*—James J. Bell
*Attorney, Agent, or Firm*—Terry T. Moyer; James M. Robertson

[57] ABSTRACT

A reinforced knitted fabric structure useful as a support member in a seating structure is provided. The reinforced knitted fabric structure has a base matrix of warp knitted yarns with elastomeric yarns running at least in the direction of the warp knitted yarns. Weft insertion yarns run through the base matrix in a direction transverse to the warp knitted yarns. The elastomeric yarns have an elongation at break of not less than about 70 percent.

12 Claims, 3 Drawing Sheets

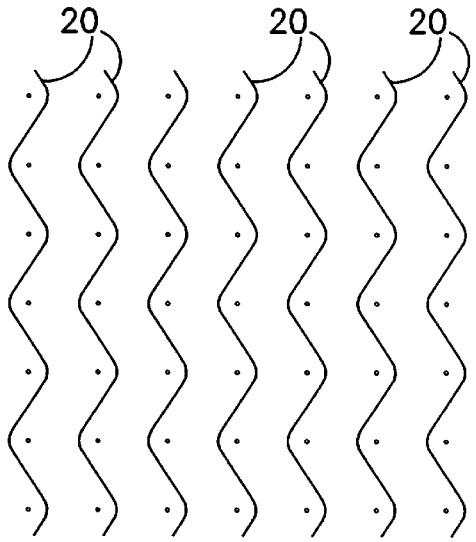
FIG. –3–
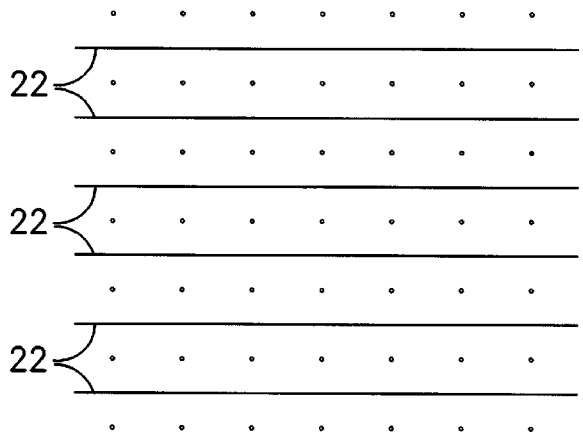
FIG. –4–
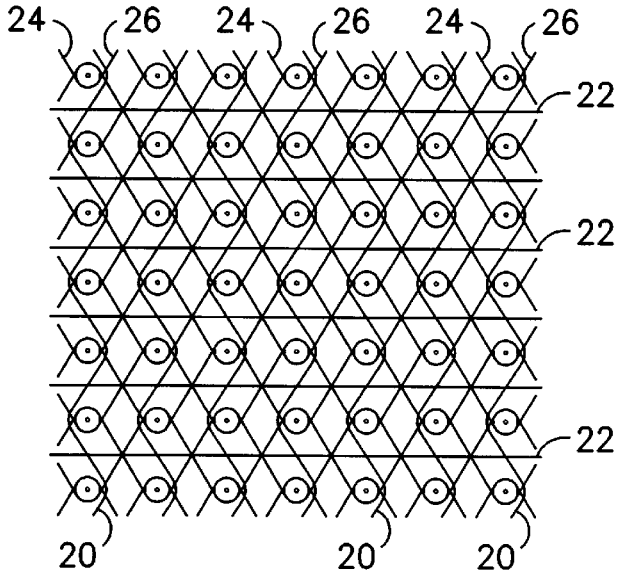
FIG. –5–

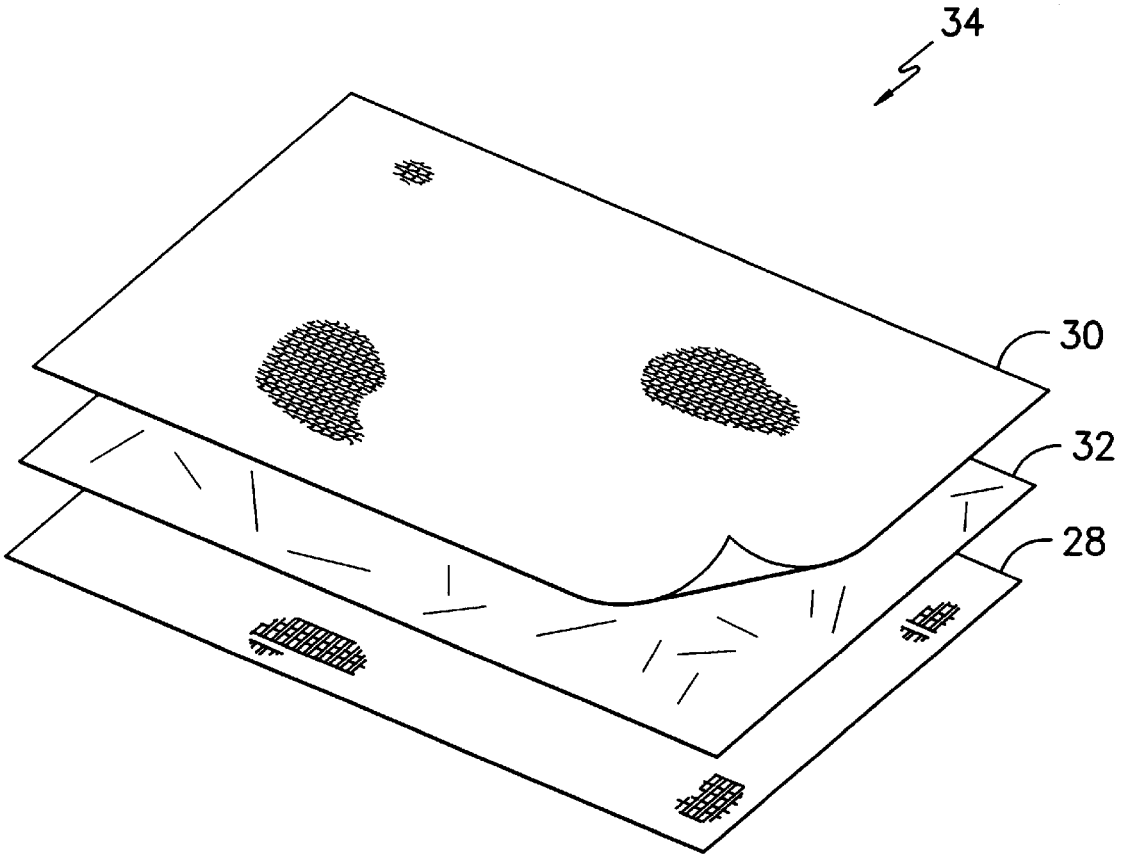
FIG. –6–

REINFORCED KNITTED FABRIC STRUCTURE USEFUL IN SEATING APPLICATIONS

REINFORCED KNITTED FABRIC STRUCTURE USEFUL IN SEATING APPLICATIONS

CROSS REFERENCE TO RELATED APPLICATION

This application is a continuation-in-part of co-pending U.S. application Ser. No. 08/744,176 in the name of George C. McLarty III having a filing date of Nov. 5, 1996 abandoned and of U.S. application Ser. No. 08/630,381 filed Apr. 10, 1996 in the name of George C. McLarty III, Anthony R. Waldrop and Kathryn T. Anderson (U.S. Pat. No. 5,632,526) which is a division of application Ser. No. 08/337,260 (U.S. Pat. No. 5,533,789) in the name of George C. McLarty, III, Anthony R. Waldrop and Kathryn T. Anderson filed on Nov. 10, 1994 references being made herein to obtain the benefit of such earlier filing dates.

FIELD OF INVENTION

This invention relates generally to support fabric for disposition across a furniture frame and relates more particularly to a reinforced knitted fabric incorporating elastomeric yarn laid through a knit base and weft insertion yarn laid through such knit base in a direction substantially transverse to the elastomeric yarns. A composite of such reinforced knitted fabric adjoined to an aesthetic cover of knit or woven fabric by means of an elastomeric adhesive is also provided.

BACKGROUND

Traditional seating structures typically are constructed from a frame, a surface fabric for contact with the user, and some type of support member. Typical support members have included springs, webs, straps, or molded units (e.g. thick foam pads). Materials for construction of such support members have been steel, burlap, canvas, plastic and elastomeric strapping and synthetic textile materials. Such synthetic textile materials are disclosed in U. S. Pat. No. 4,469,738 to Himelreich, Jr. and U.S. Pat. No. 4,469,739 to Gretzinger et al. (both incorporated by reference).

As will be readily appreciated, the use of a multiplicity of thick components (i.e. covers and separate springs or pads) which must be attached to a frame structure gives rise to a relatively complicated assembly practice. Moreover, in a number of applications such as portable beds or outdoor furniture which must be suitable to be folded and transported away for storage, it is undesirable to have thick support structures such as foam, springs, and the like as these impede portability and storage. In addition, in many applications including wheel chairs and automobile seats, it is desirable for the overall structure to be easily cleaned. At the same time, the user of such furniture in these environments must be provided with good support and a high degree of comfort generally associated with the more complicated spring and cushion configurations.

In order to reduce the number of components in seating structures and to reduce the bulk thereof, it has been proposed to provide thin profile seats, including thin seats using elastomer seat backing material. In U.S. Pat. No. 2,251,318 to Blair et al., solid rubber take or strips reinforced by fabric are stretched over a seating frame. In U.S. Pat. No. 4,4545,614 to Abu-Isa et al., (incorporated by reference) a thin profile seat is disclosed in which a multiplicity of side by side elastomeric filaments made from a block copolymer of polyterramethylene terephthalate polyester and polytetramethylene ether are stretched across a vehicle seat frame. U.S. Pat. No. 4,869,554 to Abu-Isa et al. (incorporated by reference) discloses a thin profile seat in which elastomeric filaments like that of U.S. Pat. No. 4,545,614 are woven together to form a mat. The mat was pre-stretched to at least 5% elongation and attached to the seat frame. U.S. Pat. No. 5,013,089 to Abu-Isa et al. (incorporated by reference) discloses a seat assembly having an elastomeric filament suspension and a fabric cover. The filaments in the fabric cover are integrated by having the elastomeric filaments in the fabric knitted together to provide a low profile finished seat or backrest.

The present invention provides a textile structure suitable for use as a furniture support for applications such as wheel chairs, automotive seats, airline seats, outdoor furniture and beds. The fabric provides a high degree of comfort and performance in such environments. At the same time, the fabric may be constructed so as to exhibit substantial resistance to degradation due to ultraviolet irradiation, thereby enhancing overall long term performance. Accordingly, the present invention represents a useful advancement over the state of the art.

OBJECTS AND SUMMARY OF THE INVENTION

In light of the foregoing, it is a general object of the present invention to provide a textile structure suitable for use as a furniture support having stretch and recovery performance characteristics providing support to the user.

It is a more particular object of the present invention to provide a textile structure for use as a furniture support which exhibits good stability under exposure to ultraviolet irradiation.

It is yet a further object of the present invention to provide a fabric composite of use in a seating structure including a furniture support textile joined to a cover of woven or knitted fabric such as woven or knit automotive fabric by a layer of elastomeric resin.

It is a feature of the present invention to utilize elastomeric yarns of synthetic material running through a base structure of knitted yarns wherein the elastomeric yarns are characterized by an elongation at break of not less than about 70 percent.

It is a more particular feature of the present invention to utilize elastomeric yarns having an elongation at break of not less than about 70 percent running through a base structure of warp knitted yarns at least in the same direction as the yarns forming the knitted base (i.e. the machine direction)

It is a further feature of the present invention to utilize weft inserted yarns disposed through a base structure of warp knitted yarns in a direction substantially tangential to the yarns forming the knitted base (i.e. the cross-machine direction).

According to a potentially preferred practice, it is a feature of the present invention that the elastomeric yarn is a bicomponent elastomeric monofilament having a sheath component and a core component wherein the sheath component has a melting point lower than that of the core component, although single component yarns may also be utilized.

According to yet a further potentially preferred practice, the elastomeric monofilament which is utilized is substantially stable with respect to ultraviolet irradiation.

According to one potentially preferred aspect of the present invention, a reinforced knitted fabric structure useful as a support member in a seating structure is provided. The reinforced knitted fabric structure has a base matrix of warp knitted yarns. Ultraviolet stable bicomponent elastomeric monofilament yarns are disposed through each wale of the base matrix in the machine direction. Weft inserted yarns are disposed along each course of the base matrix of warp knitted yarns in the cross machine direction transverse to warp knitted yarns and the elastomeric yarns. The elastomeric monofilament yarns are characterized by an elongation at break of at least 70 percent.

Additional objects and features of the present invention will become apparent upon reading the following detailed description and upon reference to the drawing below.

BRIEF DESCRIPTION OF THE DRAWINGS

FIG. 3 is a needle bed point diagram illustrating a potentially preferred straight through yarn arrangement for elastomeric yarns disposed through a base matrix of knitted yarns formed according to the arrangement illustrated in FIGS. 2A and 2B.

FIG. 4 is a needle bed point diagram illustrating a potentially preferred arrangement for weft inserted yarns disposed through a base structure of knitted yarns formed accordingly to the arrangement illustrated in FIGS. 2A and 2B.

FIG. 5 is a needle bed point diagram illustrating the components of the potentially preferred reinforced knit fabric construction arranged in accordance with FIGS. 2A, 2B, 3 and 4.

FIG. 6 is a perspective view of the component elements of a composite structure incorporating the fabric formed according to FIGS. 2A, 2B, 3 and 4.

While the invention has been illustrated and will be described in connection with certain preferred embodiments and procedures, it is, of course, to appreciated that there is no intention to limit the invention to such particularly illustrated and described embodiments and procedures. On the contrary, it is intended to include all alternatives, modifications, and equivalents as may be included within the true spirit and scope of the invention.

DESCRIPTION OF PREFERRED EMBODIMENTS

Figure 1:
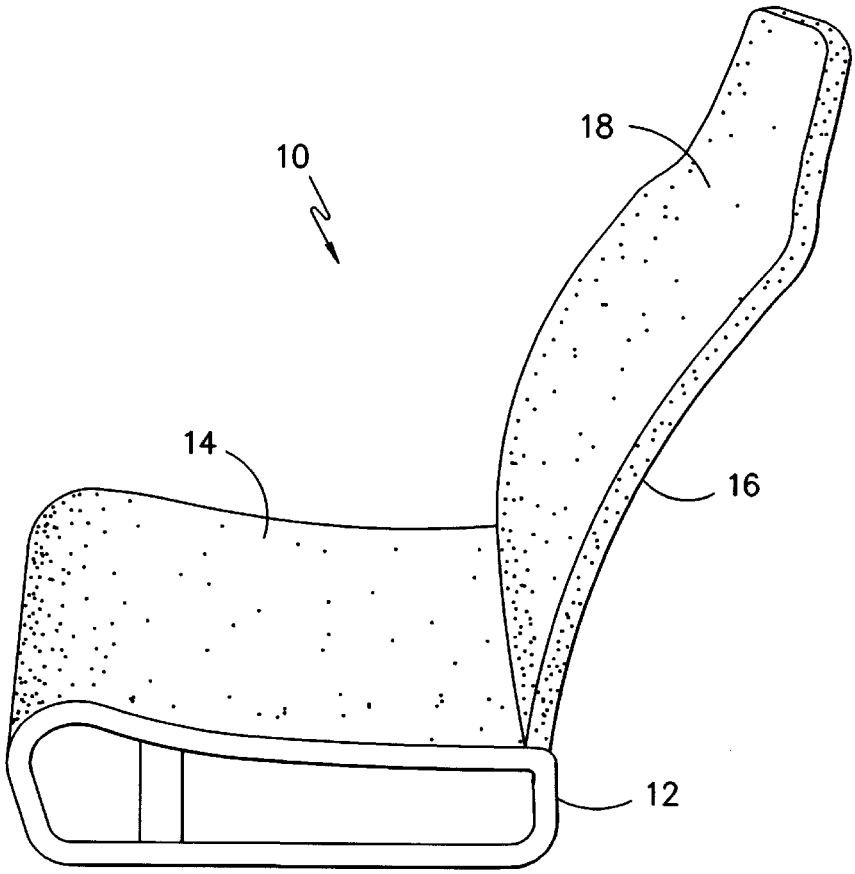
FIG. 1 is a perspective view of a seating structure incorporating a support fabric according to the present invention.

Turning now to the drawings, in FIG. 1 there is shown a seating structure 10 according to the present invention such as may be used in an automobile, an airline, an office chair or a home environment. While the actual design of the seating structure 10 may be varied depending on environment of use and aesthetic preferences, in general the seating structure will preferably include a seating frame 12, a seating support web 14, a back frame 16 and a back support web 18. In the illustrated and potentially preferred embodiment, the seating support web 14 and the back support web 18 are disposed in tension over the seating frame 12 and back frame 16 respectively. While no added cushions or other support structures are illustrated, it is contemplated that such structures could be utilized if desired. This may be particularly true for applications such as airline seating structures, where force distribution in impact environments is critical.

Figure 2A:
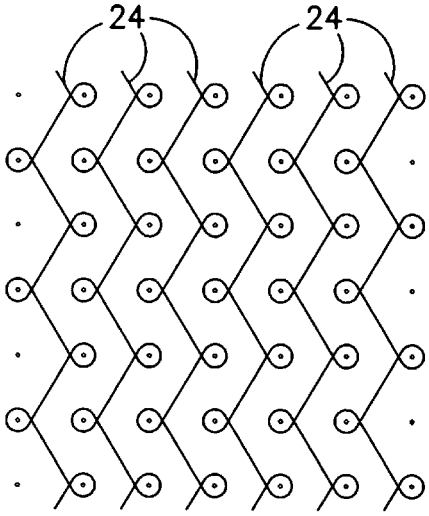
FIGS. 2A and 2B are needle bed point diagrams illustrating a potentially preferred formation practice for a matrix of warp knitted yarns in the fabric of the present invention.
Figure 2B:
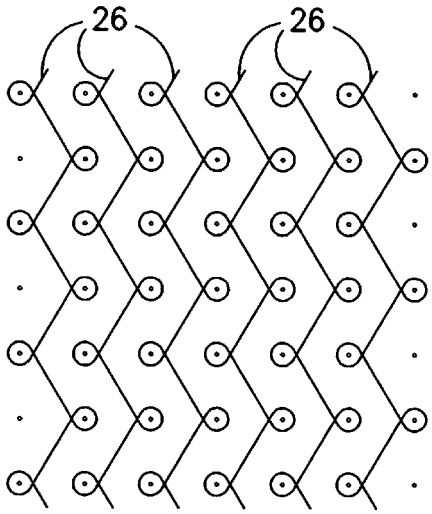

In the illustrated and potentially preferred embodiment, the fabric structure according to the present invention is a two bar warp knit, weft insertion product, wherein elastomeric yarns 20 (FIG. 3) are disposed in the warp direction and spun or textured polyester yarn 22 (FIG. 4) are inserted in the weft direction. These crossing yarns which preferably lay in substantially discreet planes in relation to one another and are preferably held together at their cross-over points by a surrounding knit matrix formed by knit yarns 24, 26 (FIG. 2A, 2B). The resulting reinforced knit fabric 28 is illustrated in FIG. 5

In the illustrated and potentially preferred configuration, the knit matrix formed by the knitting yarns 24, 26 will preferably have a bar 1 stitch notation of 0-1/2-1// and a bar 2 stitch notation of 2-1/0-1//. The stitch notation of the elastomeric yarns 20 running in the warp direction is preferably 1-1/0-0//. A weft insertion yarn preferably runs in the cross machine direction along each course formed by knitting yarns 24, 26. The greige state fabric formed by this formation practice preferably has about 30 courses per inch and about 19 wales per inch, and is finished to have about 32 courses per inch and about 19 wales per inch.

The knitting yarns 24, 26 are preferably single ply, 150 denier, 34 filament textured polyester. However, it is contemplated that other yarn types and/or liner densities may be utilized. In the potentially preferred embodiment, the weft insertion yarn 22 is textured polyester. When used in aircraft seating structures, an 8/1 ring spun polyester may be preferred. As with the other yarns, it is to be understood that alternative yarn construction may be utilized depending on the environment of use and dependent performance criteria. In particular, it is contemplated that an elastomeric yarn could be used in both the warp and the weft direction.

In one important aspect of the present invention the elastomeric yarn 20 should be characterized by a substantial elongation prior to breaking. In particular, it is believed that an elongation to break of at least about 70 percent or more is desirable in order to avoid premature failure. In a preferred practice the elastomeric yarn 20 has an elongation at break of at least 90 percent and in the most preferred practice, the elastomeric yarn 20 has an elongation at break of 100 per cent or more.

In the preferred embodiment, the elastomeric yarn is a bicomponent sheath/core elastomeric monofilament having a linear density of about 1000 denier. In the most preferred embodiment the sheath is a 640 durometer polymer having a melting point of about 180° C. and the core is a 672 durometer polymer having a melt point of about 214° C. The use of such a bicomponent structure permits these yarns to be heat tacked to the knit and weft insertion yarns during heat setting at temperatures of about 200° C. without melting the core. This further stabilizes the overall structure.

Due to the fact that seating structures such as automotive seats and outdoor furniture are exposed to significant quantities of ultraviolet radiation, it is a desired feature that the fabrics according to the present invention possess the ability to retain their tensile strength following exposure to such ultraviolet radiation. Performance in such environment is measured by accelerated exposure tests. One well known procedure for carrying out such exposure tests is set forth in SAE standard J1885. The exposure level specified as the criteria for evaluation by at least one automotive manufacture is to test based on a cumulative exposure of 488 kilojoules of UV irradiant energy according to this SAE standard.

It has been found that by selection of the appropriate elastomeric yarns 20, such ultraviolet stability can be achieved to a high degree. Specifically, it has been found that a fabric having good UV stability can be achieved if the elastomeric yarns 20 retain not less than about 85 percent and more preferably at least 95 percent of their tensile strength after exposure to 488 kilojoules of irradiant energy in accordance with SAE J1885.

In order to obtain desired performance stability in the final product it is believed that the elastomeric yarn should constitute not less than about 10 weight percent of the final product, more preferably, at least 20 weight percent of the final product, and most preferably about 25 weight percent or more of the final product. In the preferred embodiment of the present invention the elastomeric yarn comprises about 25 percent by weight of the reinforced knit fabric 28.

As previously indicated, in one potentially preferred practice, the reinforced knit fabric according to the present invention includes an aesthetic cover fabric 30. Such cover fabrics are believed of particular use in applications such as automobile and household upholstery where the users are attuned to the visual and tactile characteristics of the fabric. The aesthetic cover fabric 30 maybe either a woven or a knit fabric including a warp knit, rachael knit, double needle bar knit, and jacquard knit. Warp knits and double needle bar knits may be particularly preferred aesthetic cover fabrics. As illustrated in FIG. 6, the reinforced knit fabric 28 and the aesthetic cover fabric 30 are preferably joined together by an elastomeric adhesive web 32. The elastomeric adhesive web 32 serves to bond the reinforced knit fabric 28 to the aesthetic cover fabric 30. As will be appreciated, in order to realize the benefits of the elastomeric property of the reinforced knit fabric 28, the adhesive web 32 should not unduly inhibit the stretch of the overall composite 34. Moreover, a strong bond should be formed between the adjacent layers without unduly restricting air flow through the composite. Good air flow is believed to substantially improve the comfort of the user in applications such as automobile seats and wheel chairs. One material which is believed to be appropriate for use as the elastomeric adhesive web 32 is believed to be available through Spunfab® having a place of business at 1121 Tower Drive, Akron, Ohio 44305, under the trade designation PB 7435 EX.

In the preferred practice the elastomeric adhesive web 32 is bonded between the reinforced knit fabric 28 and the aesthetic cover fabric 30 by application of the heat and pressure on an adhesive lamination range. In the preferred practice it is believed that the machine settings on such lamination range will be about 200° C. on all heat zones with a speed setting of about 4 yards per minute and a pressure setting of about 18 Newtons per square centimeter.

The invention may be further understood by reference to the following example which is not to be construed as unduly limiting the invention.

EXAMPLE

A two bar warp knit, weft insertion, reinforced fabric was formed on a weft insertion machine. Bar 1 was fully threaded with a 1/150/34 natural polyester which was knitted using a pattern chain of 0-1/2-1//. Bar 2 was fully threaded with 1/150/34 natural polyester which was knitted using a pattern chain of 2-1/0-11//. A 1000 denier bicomponent sheath/core monofilament UV stable yarn was disposed through each wale with a pattern chain of 1-1/0-0//. A 4/150/34 textured polyester yam was laid along each course. The greige fabric had 30 courses per inch and 18 wales per inch. The fabric was heat set on a tenter at 395° F. The finished fabric had 32 courses per inch and 19 wales per inch. The fabric produced exhibited a tensile strength of 190 pounds (warp)×277 pounds (fill) and an elongation at break of 91% (warp)×30% (fill).

What is claimed is:

1. A textile structure comprising a reinforced knitted fabric having a matrix of warp knitted yarns, a plurality of weft inserted yarns disposed though said matrix in a direction substantially transverse to the knitted yarns forming said matrix and a plurality of elastomeric yarns of synthetic material disposed through said matrix in substantially the same direction as the yarns forming said matrix wherein said elastomeric yarns are characterized by an elongation at break of not less than about 70 percent.

2. The invention as in claim 1, wherein said elastomeric yarns make up not less than about 20 weight percent of the reinforced knitted fabric structure.

3. The invention as in claim 1, wherein said elastomeric yarns are further characterized by tensile strength stability following exposure to ultraviolet irradiation such that said yarns retain not less than about 85 percent of their original tensile strength upon accelerated exposure to 488 kilojoules of irradiant energy in accordance with SAE standard J1885.

4. The invention as in claim 1, wherein said elastomeric yarns comprise a sheath of a first synthetic material and a core of a second synthetic material wherein said first synthetic material has a melting point lower than the melting point of said second synthetic material.

5. The invention as in claim 4, wherein said elastomeric yarns make up not less than about 20 weight percent of the knitted fabric structure.

6. The invention as in claim 4, wherein said elastomeric yarns are further characterized by tensile strength stability following exposure to ultraviolet irradiation such that said yarns retain not less than about 85 percent of their original tensile strength upon exposure to 488 kilojoules of irradiant energy in accordance with SAE standard J1885.

7. The invention as in claim 4, wherein said sheath comprises about 30% by weight of said elastomeric yarns.

8. A seating structure incorporating the reinforced knitted fabric structure as recited in claim 1.

9. A textile structure for disposition across a seating frame, said textile structure comprising:

a warp knitted base structure including a matrix of warp knitted yarns, a plurality of weft inserted yarns extending through said matrix in a direction substantially transverse to the warp knitted yarns, and a plurality of elastomeric yarns of synthetic material disposed substantially in the direction of the warp knitted yarns wherein said elastomeric yarns are characterized by an elongation at break of not less than about 70 percent;

an aesthetic cover fabric disposed over said base structure; and a layer of elastomeric resin joining said base structure to said aesthetic cover fabric.

10. The invention as in claim 9, wherein said elastomeric yarns comprise a sheath of a first synthetic material and a core of a second synthetic material, wherein said first synthetic material has a melting point lower than the melting point of said second synthetic material.

11. The invention as in claim 9, wherein said aesthetic cover fabric is a woven fabric.

12. The invention as in claim 9, wherein said aesthetic cover fabric is a knit fabric.

* * * * *